US009814319B2

(12) United States Patent
Miller et al.

(10) Patent No.: US 9,814,319 B2
(45) Date of Patent: Nov. 14, 2017

(54) CONFIGURABLE SEATING ASSEMBLY

(71) Applicant: American National Manufacturing, Inc., Corona, CA (US)

(72) Inventors: Chad Shane Miller, Corona, CA (US); Joseph Charles Bonner, Irvine, CA (US)

(73) Assignee: American National Manufacturing, Inc., Corona, CA (US)

( * ) Notice: Subject to any disclaimer, the term of this patent is extended or adjusted under 35 U.S.C. 154(b) by 0 days.

(21) Appl. No.: 14/492,991

(22) Filed: Sep. 22, 2014

(65) Prior Publication Data

US 2015/0084382 A1 Mar. 26, 2015

Related U.S. Application Data

(60) Provisional application No. 61/880,680, filed on Sep. 20, 2013.

(51) Int. Cl.

| | |
|---|---|
| ***A47C 13/00*** | (2006.01) |
| ***A47C 31/00*** | (2006.01) |
| ***A47G 9/06*** | (2006.01) |
| ***A47C 1/14*** | (2006.01) |
| ***A47C 4/52*** | (2006.01) |

(52) U.S. Cl.

CPC ..... *A47C 13/00* (2013.01); *A47C 1/146* (2013.01); *A47C 4/52* (2013.01); *A47C 31/007* (2013.01); *A47G 9/062* (2013.01)

(58) Field of Classification Search

CPC ..... A47C 13/00; A47C 4/52; A47C 1/146
USPC ..... 297/219.1, 219.12, 230.1–230.14, 284.5; 5/640, 645, 657, 722
See application file for complete search history.

(56) References Cited

U.S. PATENT DOCUMENTS 2,023,605 A 12/1935 Mandell
2,126,588 A 8/1938 Thum
(Continued)

FOREIGN PATENT DOCUMENTS

CN 2214771 12/1995
CN 2688155 3/2005
(Continued)

OTHER PUBLICATIONS

Internet definition of "pocket" www.dictionary.com/browse/pocket.*

*Primary Examiner* — Adriana Figueroa
(74) *Attorney, Agent, or Firm* — Spencer Fane LLP

(57) ABSTRACT

A configurable seating assembly includes a plurality of rectangular pad assemblies disposed within a durable cover assembly. The cover includes a generally triangular or tapered upper chamber forming a back support portion above a generally rectangular lower chamber forming a body support portion. A wedge assembly, manufactured from a foam material, is removably positioned in the upper chamber, and the pads, manufactured from a foam material, are positioned in the compartments of a separator assembly within the lower chamber thereby providing a seating apparatus. A front panel at the forward end of the lower chamber provides an opening into the cover assembly allowing insertion and removal of the wedge and pads. The pads may be removed from the cover and arranged on the floor providing pads for sleeping. The front panel is releasably secured to the cover by cooperating removable connectors.

6 Claims, 13 Drawing Sheets

(56) References Cited

U.S. PATENT DOCUMENTS

| | | | | | |
|---|---|---|---|---|---|
| 2,589,579 | A | | 3/1952 | Slayen | |
| 3,148,389 | A | * | 9/1964 | Lustig | 5/645 |
| 3,742,526 | A | * | 7/1973 | Lillard | 5/12.1 |
| 3,902,759 | A | | 9/1975 | Monteforte | |
| 3,953,072 | A | * | 4/1976 | Esquivel | A47G 9/10 297/452.32 |
| 4,192,032 | A | | 3/1980 | Geraci | |
| 4,293,965 | A | * | 10/1981 | Hrubec | 5/705 |
| 4,326,309 | A | | 4/1982 | Flaum | |
| 4,442,556 | A | | 4/1984 | Craigie | |
| 4,689,844 | A | * | 9/1987 | Alivizatos | 5/702 |
| 4,694,515 | A | | 9/1987 | Rogers | |
| 4,777,678 | A | * | 10/1988 | Moore | 5/657 |
| 4,970,742 | A | * | 11/1990 | Keener | 5/633 |
| 4,985,952 | A | * | 1/1991 | Edelson | 5/722 |
| 5,038,432 | A | * | 8/1991 | Robillard et al. | 5/645 |
| 5,066,001 | A | | 11/1991 | Wilkinson | |
| 5,088,747 | A | * | 2/1992 | Morrison et al. | 297/219.1 |
| 5,168,590 | A | * | 12/1992 | O'Sullivan | 5/490 |
| 5,303,977 | A | * | 4/1994 | Sereboff | 297/230.1 |
| 5,491,851 | A | | 2/1996 | Alonso | |
| 5,657,500 | A | | 8/1997 | Messina | |
| 5,987,676 | A | * | 11/1999 | Littleford et al. | 5/636 |
| 6,618,883 | B2 | | 9/2003 | Angland | |
| 6,671,906 | B1 | * | 1/2004 | Milligan | 5/636 |
| 6,918,146 | B2 | * | 7/2005 | England | 5/653 |
| 6,925,669 | B1 | * | 8/2005 | Friedman et al. | 5/657 |
| 7,681,263 | B1 | * | 3/2010 | Hawkins | 5/640 |
| 7,900,999 | B2 | | 3/2011 | Reynolds | |
| 8,499,388 | B1 | * | 8/2013 | Copes | 5/653 |
| 8,844,105 | B2 | * | 9/2014 | LaRoche | A47C 3/16 29/91.1 |
| 8,973,191 | B1 | * | 3/2015 | Kvitek | 5/640 |
| 2003/0205920 | A1 | * | 11/2003 | Sprouse et al. | 297/219.1 |
| 2008/0098533 | A1 | * | 5/2008 | Erdman | 5/722 |
| 2008/0235877 | A1 | * | 10/2008 | Murray et al. | 5/640 |
| 2009/0146481 | A1 | * | 6/2009 | Fernandez Perez | 297/452.1 |
| 2009/0199341 | A1 | * | 8/2009 | Schantz | 5/645 |
| 2013/0263377 | A1 | * | 10/2013 | Wootten, Jr. | 5/640 |

FOREIGN PATENT DOCUMENTS

| | | |
|---|---|---|
| CN | 201175172 | 1/2009 |
| CN | 202396985 | 8/2012 |
| EP | 1779745 | 5/2007 |
| JP | H08322682 | 12/1996 |
| JP | 2000270971 | 10/2000 |
| JP | 2000279275 | 10/2000 |
| MX | 2010002072 | 8/2011 |

* cited by examiner

CONFIGURABLE SEATING ASSEMBLY

BACKGROUND

The present disclosed subject matter relates generally to body support apparatus, and more particularly to a configurable seating assembly.

Child care and school environments use a variety of body support apparatuses designed to accommodate the activity level of the child at any given time, namely sitting and resting. Sitting requires stools or chairs that only serve to support the child when sitting. Resting requires mats that only serve to support the child when laying down, resting, or sleeping. In addition to serving limited functions, chairs, stools, and cots are bulky and do not stack very well. Storing the chairs, stools, and mats presents a safety hazard because children are prone to climb the items when they are stacked, and as a result, the items are prone to toppling upon them. Moreover, stored, single use support apparatuses take up space in the child care environment thereby reducing space for other activities and items.

SUMMARY

A convertible seating assembly includes a cover assembly with a lower body support chamber having two or more removable pad assemblies therein. The cover assembly includes a front panel that opens allowing a user to insert and remove the pad assemblies from compartments therein. The compartments are separated by fabric panels for separating the pad assemblies when they are in the cover assembly.

Each pad assembly includes a mat surrounded by a cover. The cover may be one piece, or comprise an upper cover half and a lower cover half. The upper cover is a barrier material, and the lower cover is a barrier material having antimicrobial properties.

The two or more pad assemblies can be removed from the seating assembly when it is not being used as such, and the pad assemblies can be arranged together on the floor, or separated and used individually, allowing a user to rest thereon. The pad assemblies may be stored within the cover assembly when they are not used on the floor for resting.

An alternative embodiment seating assembly includes a back support portion along the top edge. The back support portion includes an upper chamber having an opening into the body support chamber. A resilient tapered or wedge assembly is inserted into the upper chamber and the opening is secured with a cooperating removable connector.

DESCRIPTION OF THE DRAWINGS

The drawings constitute a part of this specification and include exemplary embodiments of the disclosed subject matter and illustrate various objects and features thereof.

DETAILED DESCRIPTION

Figure 1:
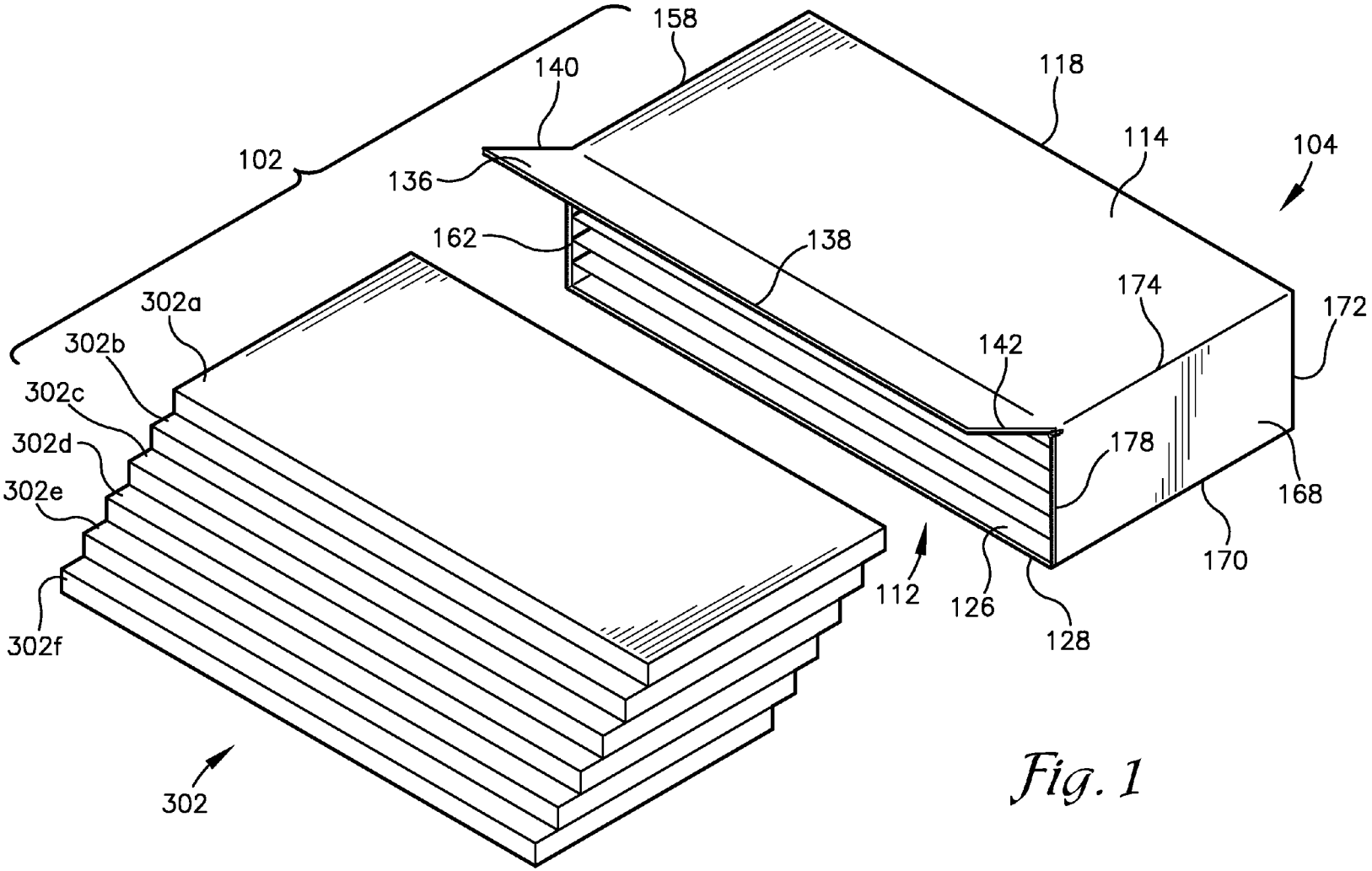
FIG. 1 is a perspective view of a configurable seating assembly embodying principles of the disclosed subject matter.
Figure 2:
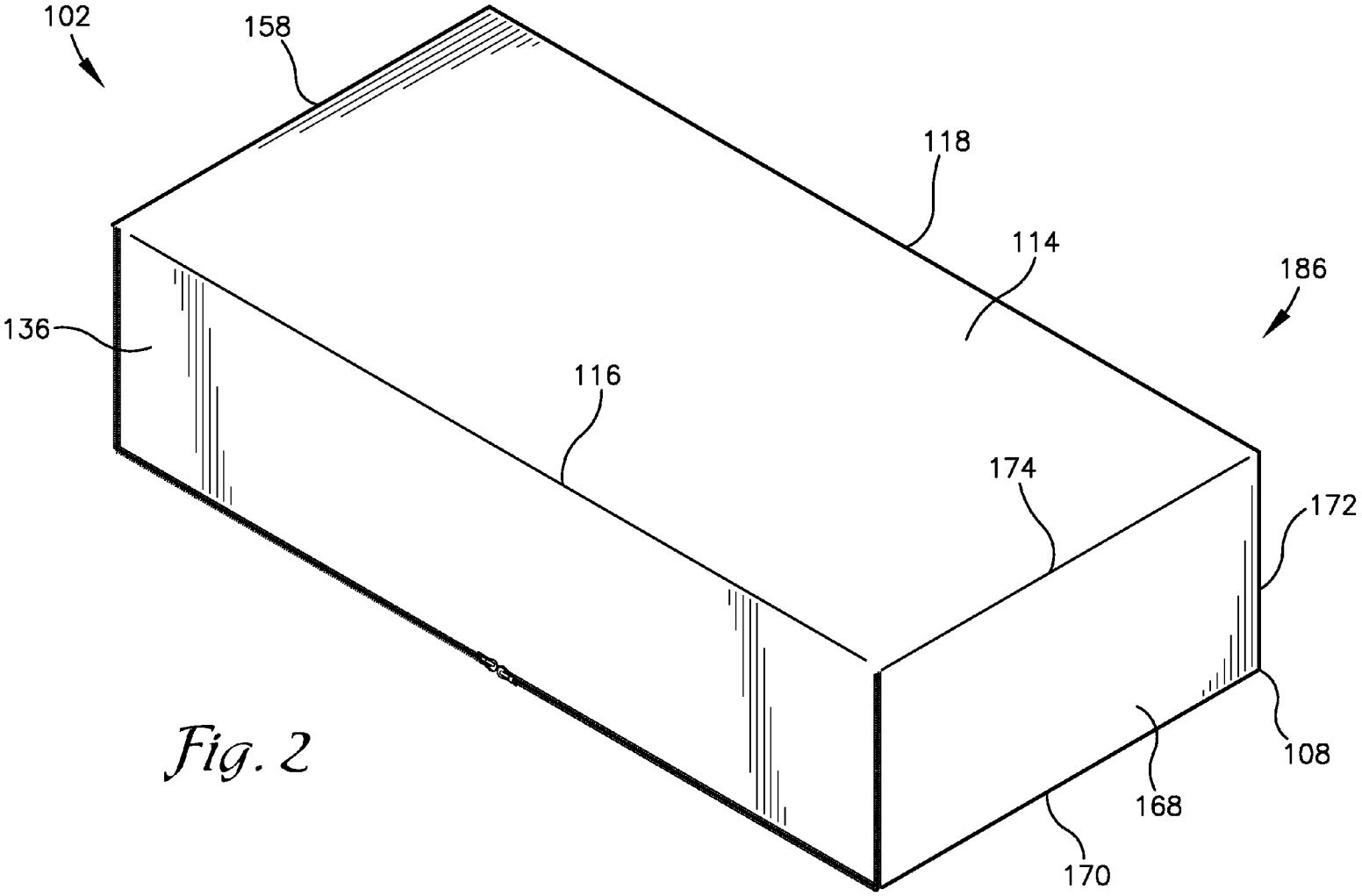
FIG. 2 is a perspective view of the configurable seating assembly.

As required, detailed aspects of the disclosed subject matter are disclosed herein; however, it is to be understood that the disclosed aspects are merely exemplary of the disclosed subject matter, which may be embodied in various forms. Therefore, specific structural and functional details disclosed herein are not to be interpreted as limiting, but merely as a basis for the claims and as a representative basis for teaching one skilled in the art how to variously employ the disclosed technology in virtually any appropriately detailed structure.

Certain terminology will be used in the following description for convenience in reference only and will not be limiting. For example, up, down, front, back, right, and left refer to the disclosed subject matter as orientated in the view being referred to. The words, inwardly and outwardly refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof, and words of similar meaning.

Referring to FIGS. 1-8, an embodiment of a configurable seating assembly 102 is shown. The assembly 102 may be used as a playing surface, or as a support surface, such as a bench, seat, or table. The configurable seating assembly 102 generally includes a cover assembly 104 and two or more pad assemblies 302. When the configurable seating assembly 102 is assembled as a seating apparatus 186 (FIG. 2) a person, such as a child, may sit on the assembly 102 supported from below by the pad assemblies 302 within the cover assembly 104. When the pad assemblies 302 are removed from the cover assembly 104, the pad assemblies can be separated and spaced apart on a floor providing individual pads (FIG. 3*b*) for users to rest or sit on. Alternatively, two or more pad assemblies 302 can be arranged in an edge to edge abutting arrangement to form a reconfigurable mat assembly 304 (FIG. 3*a*) allowing a person to rest or sit on the mat assembly 304. The configurability of the assembly 102 allows it to serve at least two functions, one as a seating device, and two as a resting device, thereby allowing a user to avoid a need for a separate seating and resting device and minimizing the use of space within an environment.

The cover assembly 104 is manufactured from a durable flexible material, including vinyl, and vinyl laminate, and forms a lower chamber for receiving the pad assemblies 302 thereby defining a body support portion 108. Alternatively, the cover assembly 104 is manufactured from Consumer Product Safety Improvement Act (CPSIA) compliant materials. The cover assembly 104 includes a generally rectangular bottom panel 126 extending laterally between a bottom edge 154 of a left panel 152 and a bottom edge 170 of a right panel 168, and rearward from a front edge 128 toward a back panel 150 at a rear edge 130. The back panel 150 is generally rectangular and extends laterally between a back edge 156 of the left panel 152 and a back edge 172 of the right panel 168, and upward from the rear edge 130 toward a rear edge 118 of a first top panel 114. The first top panel 114 is generally rectangular and is disposed higher, and generally parallel to, the bottom panel 126 forming a seating surface. The first top panel 114 extends laterally between a first top edge 158 of the left panel 152 and a first top edge 174 of the right panel 168, and rearwardly from a front edge 116 to a rear edge 118, whereby the rear edge 118 terminates at the back panel 150. A first front panel 136 is generally rectangular and extends laterally between a left edge 140 adjacent a first front edge 162 of the left panel and a right edge 142 adjacent a first front edge 178 of the right panel 168, and downwardly from the first top panel 114 front edge 116. The bottom edge 138 disposed adjacent the bottom panel 126 front edge 128. The first front panel 136 is movably connected to the first top panel 114 at the front edge 116, and the bottom edge 138, left edge 140, and right edge 142 are connected to the bottom panel 126, left panel 152, and right panel 168, respectively, by a cooperating removable connector thereby providing an opening 112 for inserting the pad assemblies 302 into the lower chamber 110.

The individual panels above are assembled to form the cover assembly 104. In another embodiment, the left panel 152, bottom panel 126, and right panel 168 comprise a first monolithic pieces of material, and the back panel 150, top panel 114, and first front panel 136 comprise a second monolithic piece of material, wherein the first and second monolithic pieces are jointed to form the cover assembly 104.

In an embodiment, the cooperating removable connector comprises a hookless fastener such as a zipper, whereby the first side chain 408 is disposed along the left edge 140, bottom edge 138, and right edge 142, and a cooperating second side chain 410 is disposed along the first front edge 162, front edge 128, and first front edge 178. Movement of a slider 412 with a pull tab 414 in a first direction along the first and second side chains 408, 410 engages the side chains 408, 410 securing the first front panel 136 to the cover assembly 104, and movement of the slider 412 in a second direction releases the edges 138, 140, 142 from the cover assembly 104.

In an embodiment, the zipper includes two sliders 412, a first slider 412*a* that engages the side chains 408, 410 as it moves from the intersection of the front edge 116, first front edge 162, and left edge 140 toward the middle of the bottom edge 138, and a second slider 412*b* that engages the side chains 408, 410 as it moves from the intersection of the front edge 116, first front edge 178, and right edge 142 toward the middle of the bottom edge 138.

The cover assembly 104 provides a series of interior panels defining a series of compartments for supporting the pad assemblies 302. In an embodiment the compartments are accessed from the front of the cover assembly 105. A first compartment 202 is formed by the first top panel 114 and an opposite first interior bottom panel 204. A second compartment 212, disposed below the first compartment 202, is formed by the first interior bottom panel 204 and an opposite second interior bottom panel 214. A third compartment 222, disposed below the second compartment 212, is formed by the second interior bottom panel 214 and an opposite third interior bottom panel 224. A fourth compartment 232, disposed below the third compartment 222, is formed by the third interior bottom panel 224 and an opposite fourth interior bottom panel 234. A fifth compartment 242, disposed below the fourth compartment 232, is formed by the fourth interior bottom panel 234 and an opposite fifth interior bottom panel 244. A sixth compartment 252, disposed below the fifth compartment 242, is formed by the fifth interior bottom panel 244 and the opposite bottom panel 126. The a back panel 150 forms the rear portion of each compartment. In an embodiment, the first front panel 136, the first top panel 114, back panel 150, and bottom panel 126 are manufactured from a single piece of material cut along an outer edge, with the intervening compartments formed therebetween. Pad assemblies 302 are received within the compartments thereby separating the pad assemblies 302 so they are not touching, and aligning the pad assemblies 302 so they remain together, one on top of the other, within the cover assembly 104. A pocket 256 with a transparent window is attached to the top surface of each panel 204, 214, 224, 234, 244, and 126 allowing for the retention of identifying information, such a name or number associated with the particular pad assembly 302 stored within the associated compartment.

The panels 204, 214, 224, 234, 244 are manufactured from a durable flexible material, including fabric, vinyl, and vinyl laminates. In an embodiment, the aforementioned panels include an additional layer of material on their upper surface. The contact points between the left and right edges of the panels, and left and right panels 152, 168 form seams 254 that are secured together by suitable means, including bonding, sewing, or radio frequency or sonic sealing.

Pad assemblies 302 are received within the compartments thereby separating the pad assemblies 302 so they are not touching, and aligning the pad assemblies 302 so they remain together, one on top of the other, within the cover assembly 104.

Referring to FIGS. 5-7*b*, pad assemblies 302*a*, 302*b*, 302*c*, 302*d*, 302*e*, and 302*f* are shown. Each pad assembly 302 includes a mat 304 within a pad cover assembly 352. The mat 304 is generally rectangular panel having a rectangular cross-section manufactured from a resilient material including foam, densified polyester fiber, or non-fire retardant foam. The pad cover assembly 352 may be manufactured from a single piece of material that envelopes the mat 304, or may include two or more pieces of material secured together to envelope the mat 304. In an embodiment, the pad cover assembly 352 includes an upper cover 354 secured to a lower cover 366.

Figure 7A:
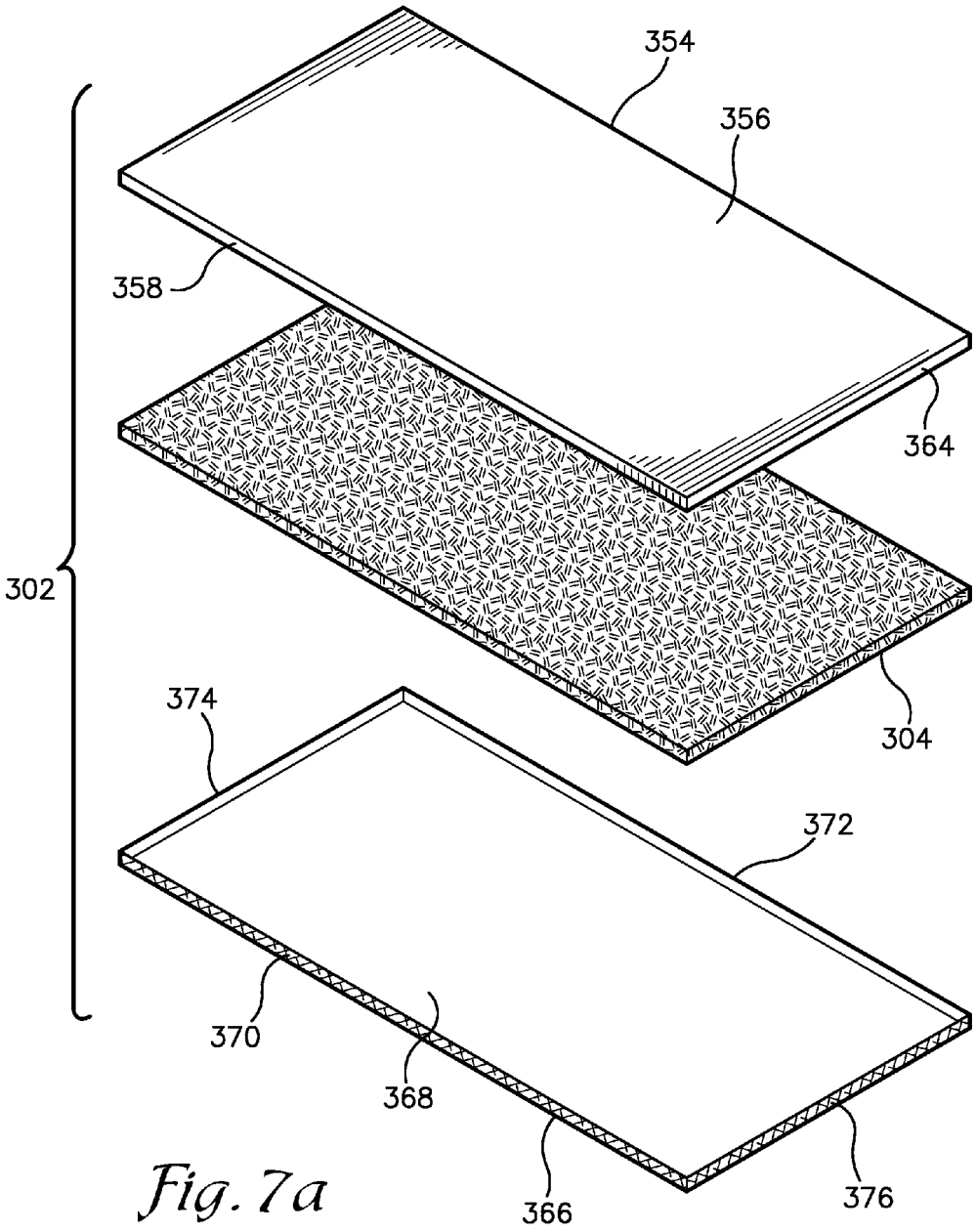
FIG. 7*a* is an exploded view of the pad assembly.

Referring to FIG. 7*a*, an embodiment of the pad assembly 302 is shown and described where the upper cover 354 includes a top wall 356, with a front wall 358, an opposite back wall, left wall, and right wall 364 depending therefrom. The lower cover 366 includes a bottom wall 368, with a front wall 370, back wall 372, left wall 374, and right wall 376 extending upward therefrom. The aforementioned features of each the upper cover 354 and lower cover 366 can be manufactured as separate components secured together at seams, or can be formed as a single component from a seamless piece of material. The front walls 358 and 370 are secured together at a first seam 378, the upper cover 354 back wall and back wall 372 are secured together at a second seam, the upper cover 354 left wall and left wall 374 are secured together at a third seam, and the right walls 364 and 376 are secured together at a fourth seam 384. The upper cover 354 is manufactured from a barrier material, including an antimicrobial material, including HERCULITE brand material manufactured by Herculite Products, Inc. of Emigsville, Pa., USA, a vinyl CPSIA complaint barrier material, including Aquatex brand material by Pil Membranes, Ltd., United Kingdom, and a polyvinyl chloride (PVC) free material, including Baby Soft brand material by Chemtick Coated Fabrics, Inc. of Jericho, N.Y., USA. The lower cover 366 is manufactured from a barrier material, such as SAFE GUARD BARRIER SYSTEMS material manufactured by Vintex, Inc. of Ontario, Canada.

Figure 7B:
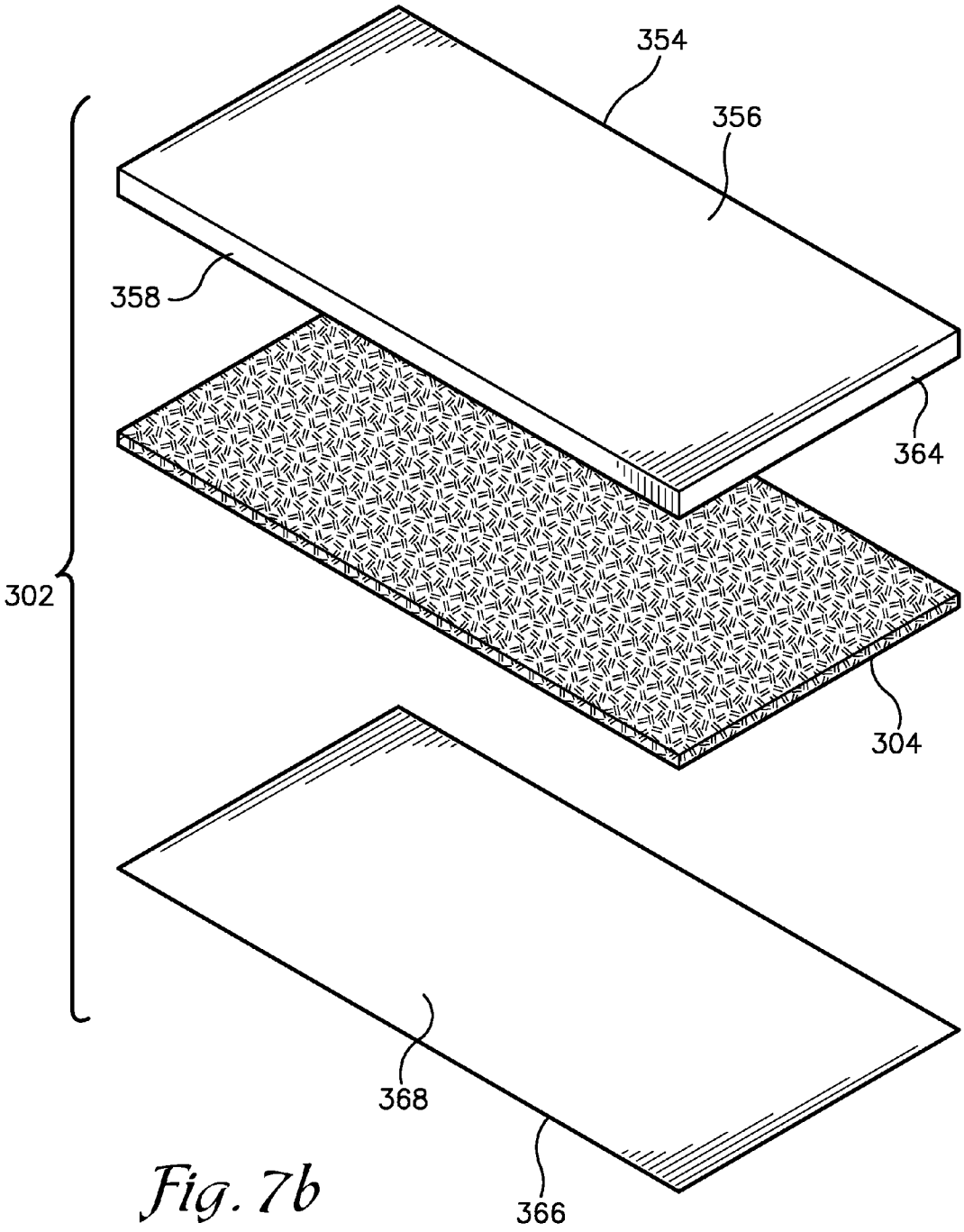
FIG. 7*b* is an exploded view of an alternative embodiment pad assembly.
Figure 8:
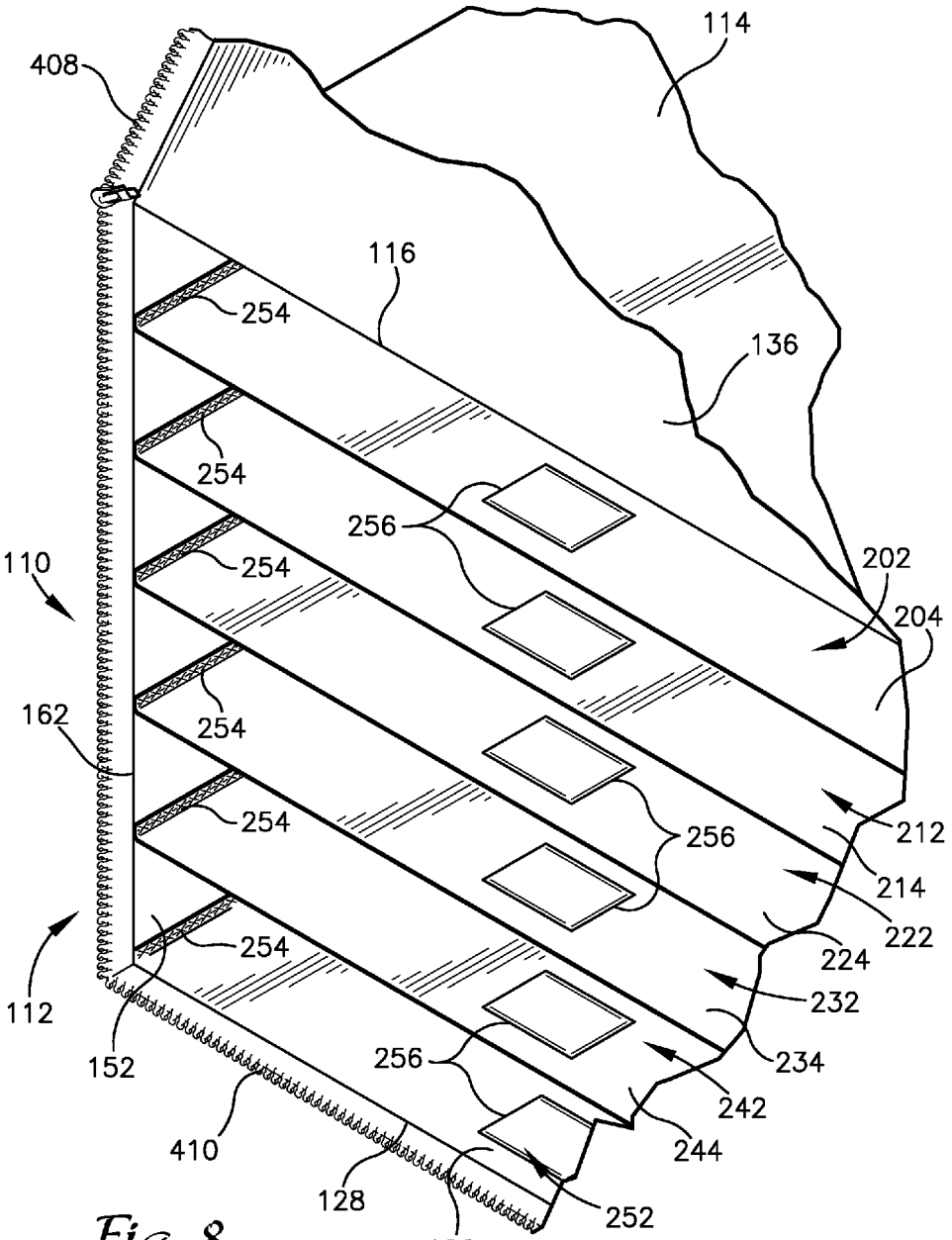
FIG. 8 is an enlarged partial view of the front of the separator assembly.
Figure 9:
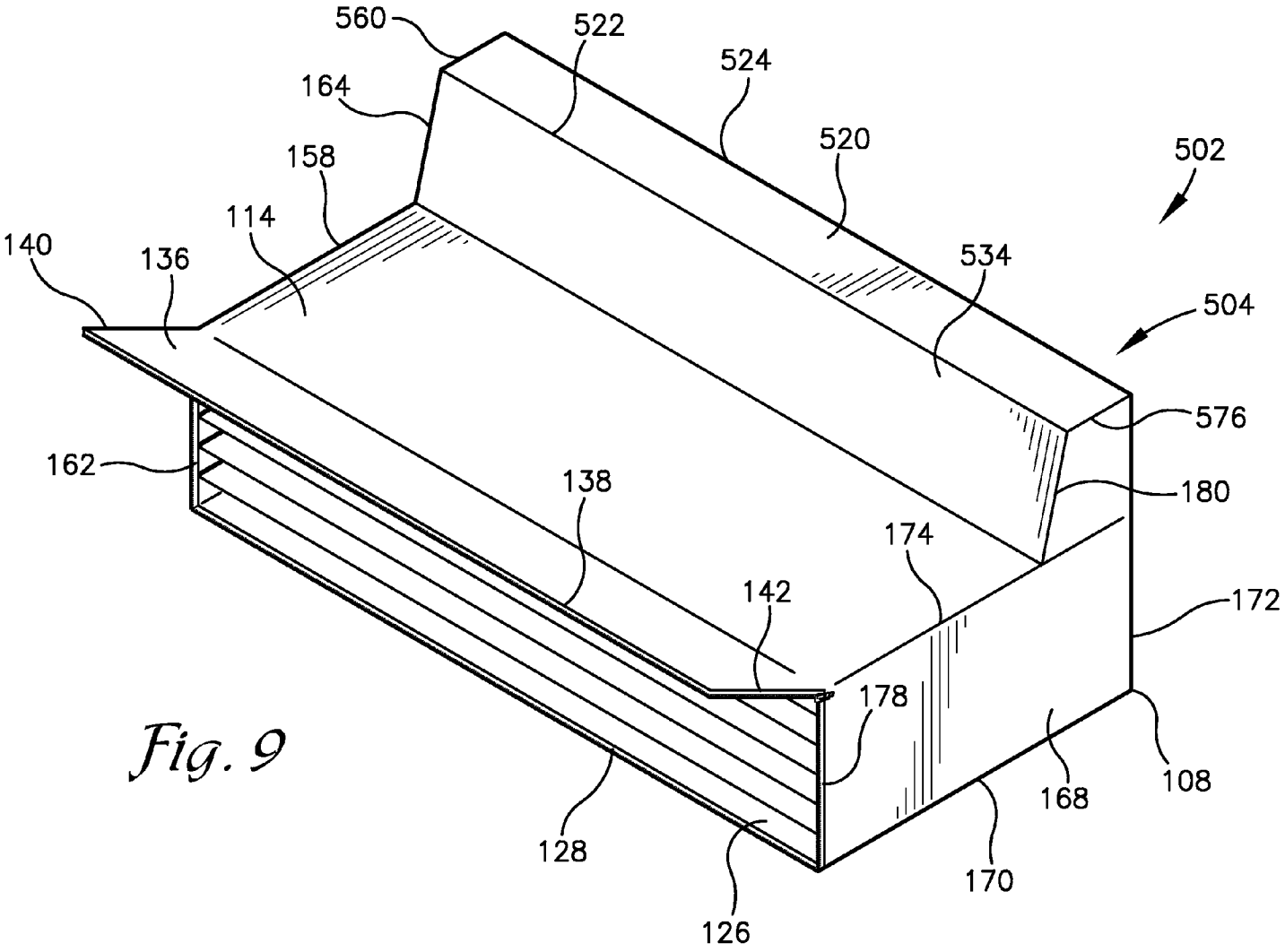
FIG. 9 is a perspective view of an alternative embodiment seating assembly embodying principles of the disclosed subject matter.
Figure 10:
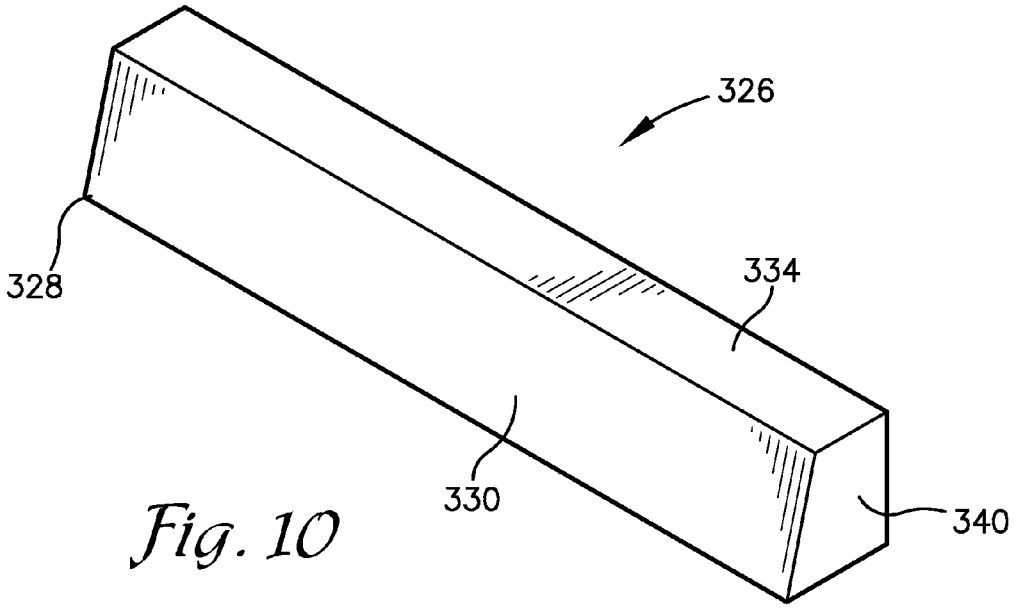
FIG. 10 is a perspective view from above of a wedge assembly.
Figure 11:
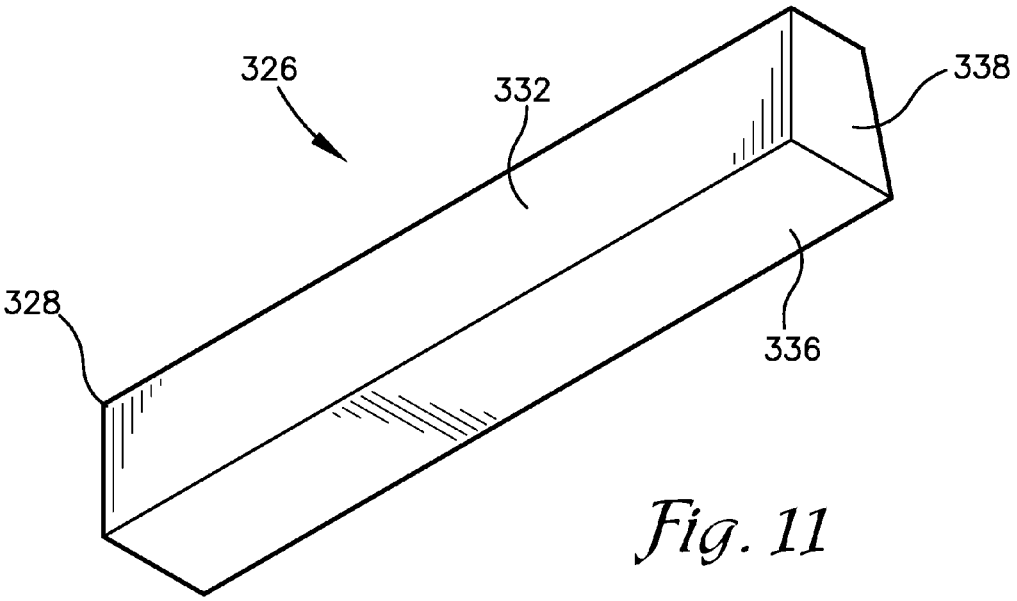
FIG. 11 is a perspective view from below of the wedge assembly.
Figure 12:
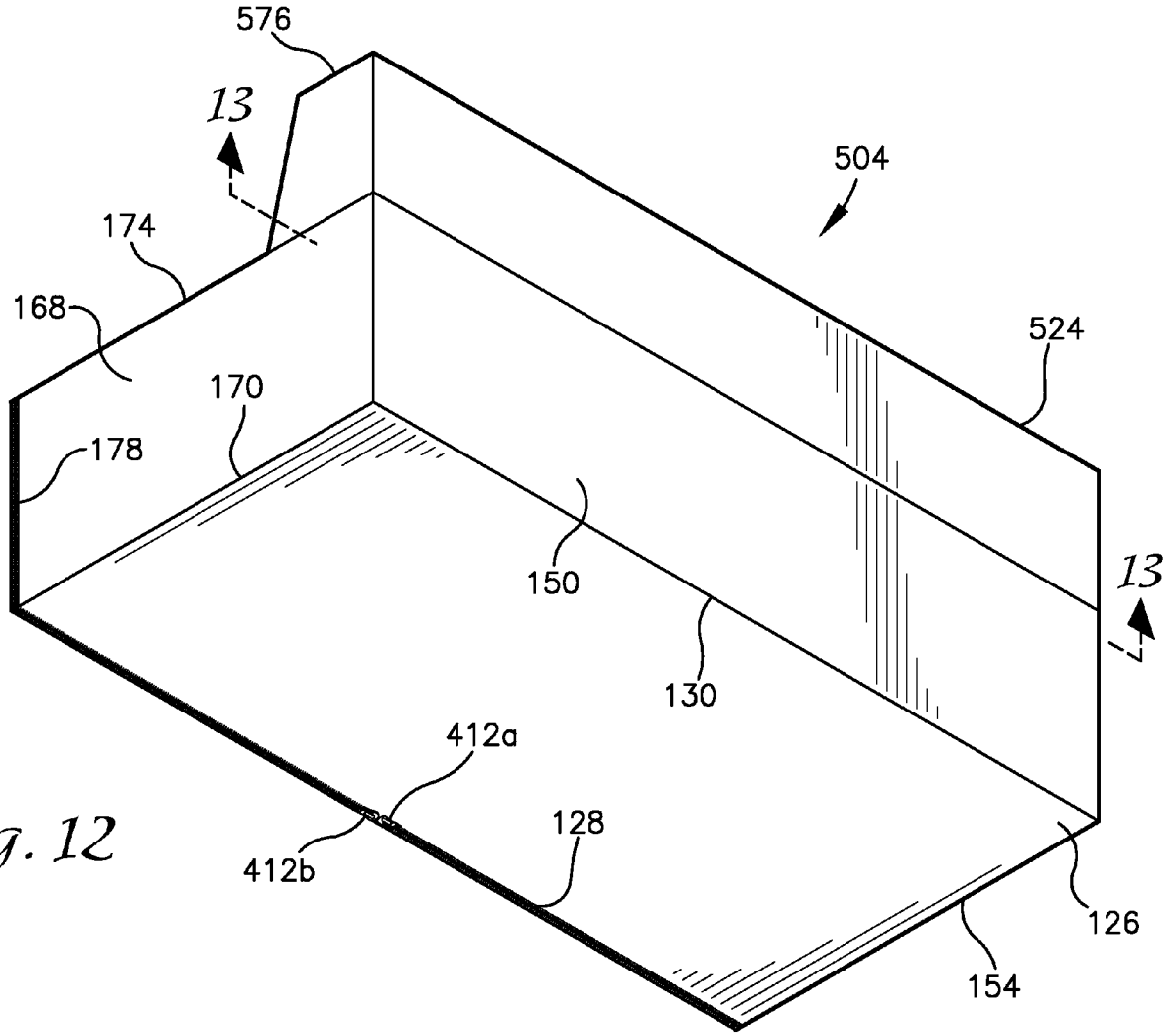
FIG. 12 is a perspective view from below of the alternative embodiment seating assembly.
Figure 13:
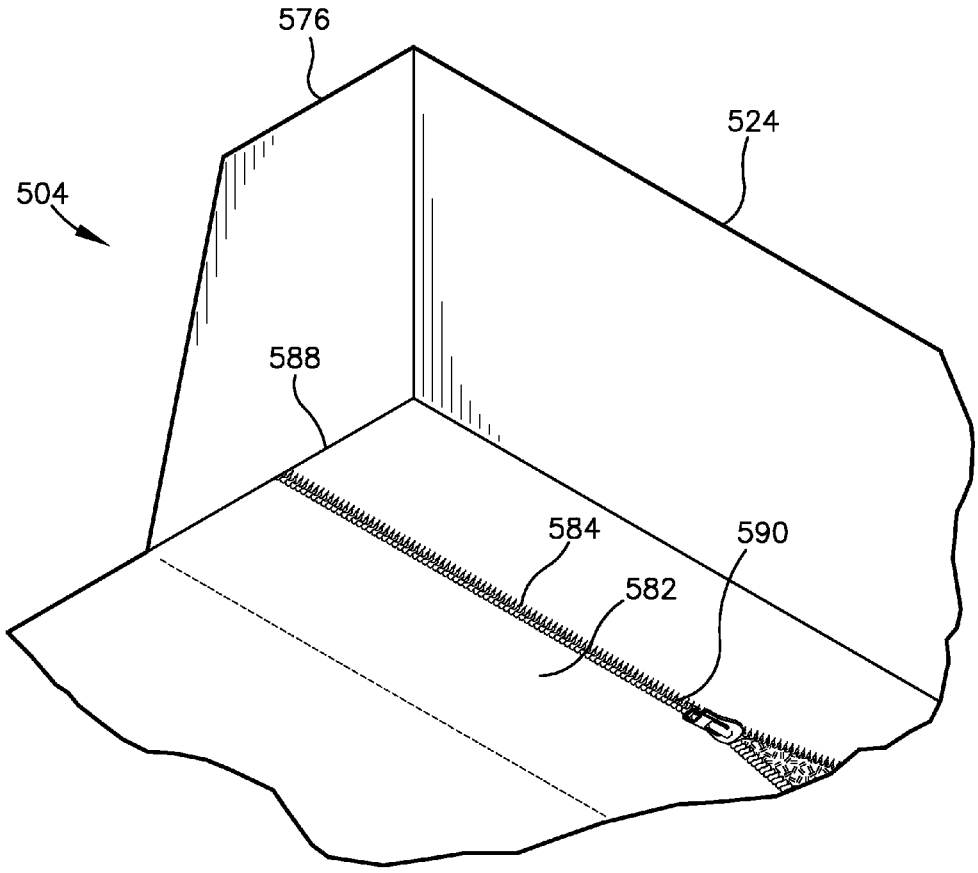
FIG. 13 is a perspective sectional view from below of the access to the upper chamber.

Referring to FIG. 7*b*, an alternative embodiment of the pad assembly 302 is shown and described where the upper cover 354 includes a top wall 356, with a front wall 358, an opposite back wall, left wall, and right wall 364 depending therefrom. The lower cover 366 comprises solely a bottom wall 368. The front walls 358 is secured to the front edge of the bottom wall 368 at a first seam, the back wall is secured to the back edge of the bottom wall 368 at a second seam, the left wall is secured to the left edge of the bottom wall 368 at a third seam, and the right wall 364 is secured to the right edge of the bottom wall 368 at a fourth seam.

A pocket 400 with a transparent window is attached to the top surface of each pad assembly 302*a*, 302*b*, 302*c*, 302*d*, 302*e*, and 302*f* allowing for the retention of identifying information, such a name or number associated with the particular compartment the pad assembly is stored in. For example, pad assembly 302*a* may be stored in the first compartment 202. The first compartment 202 is bound at the top by the first top panel 114, and at the bottom by the first bottom panel 204. The first bottom panel 204 includes a pocket 256. A user may be assigned pad assembly 302*a*. Identifying information associated with the user may be placed in pocket 400, and the same identifying information may be placed in pocket 256. Thus the user knows to retrieve pad assembly 302*a*, and to return pad assembly 302*a* to compartment 202 for storage.

Figure 3A:
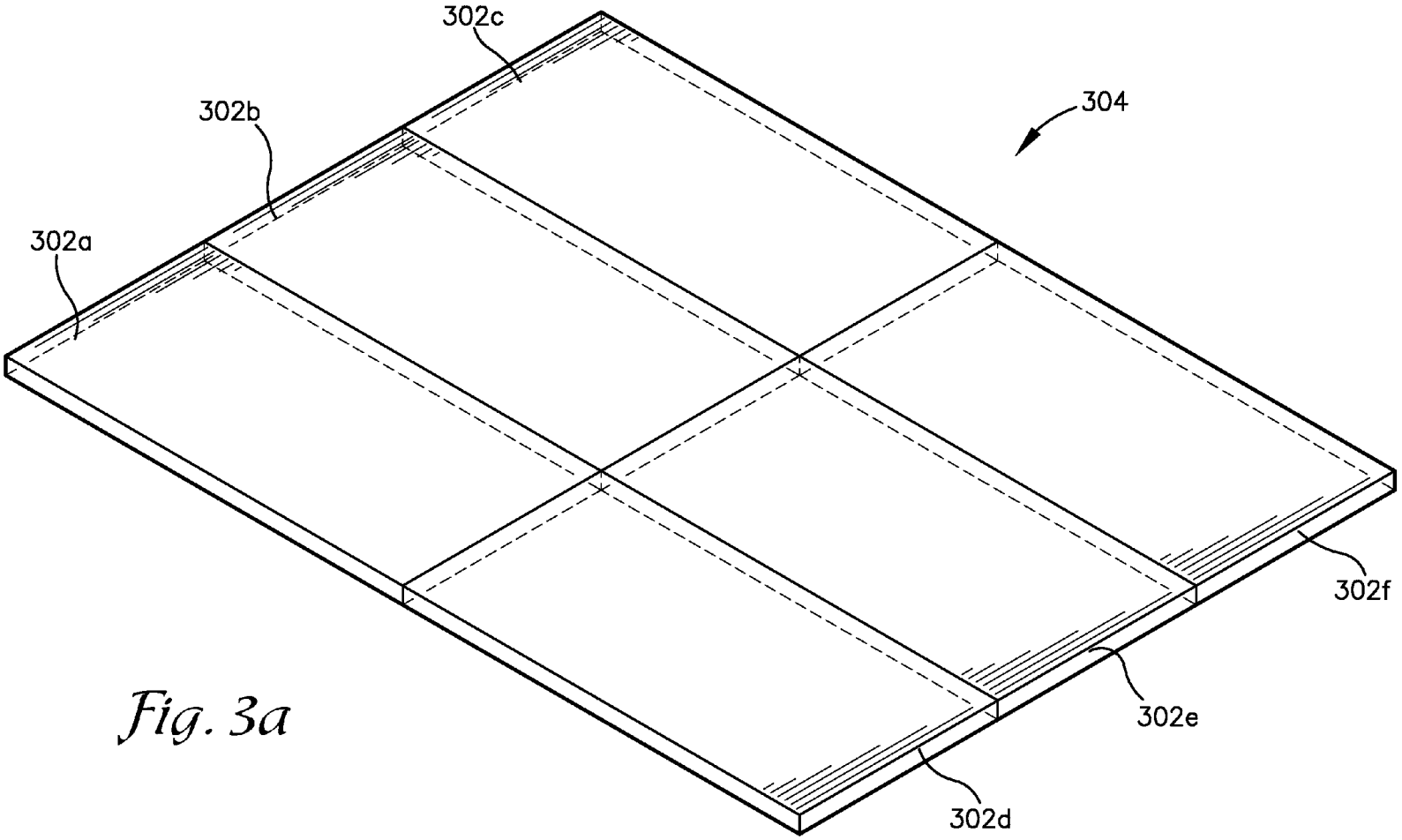
FIG. 3*a* is a perspective view of a reconfigurable mat assembly.
Figure 3B:
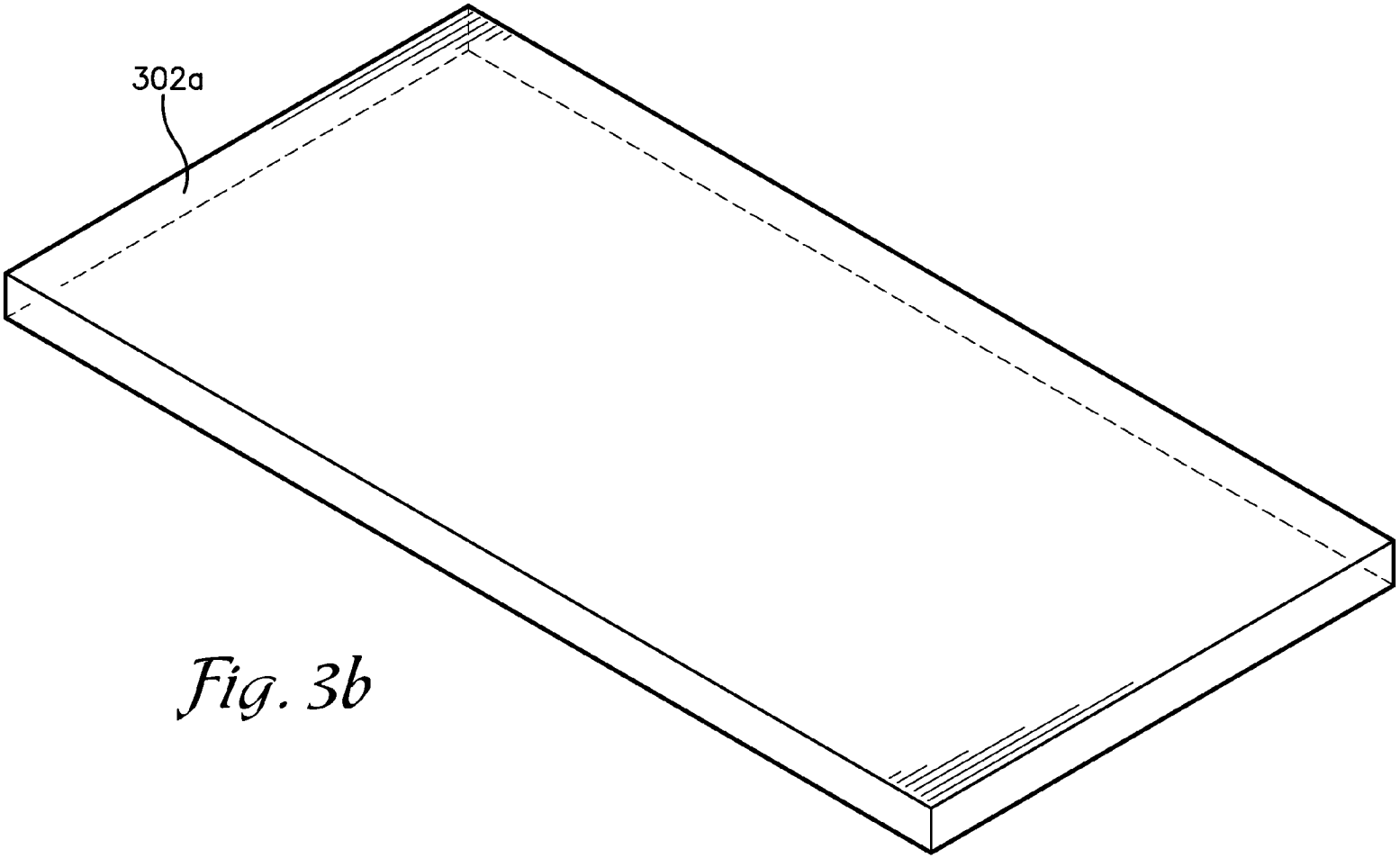
FIG. 3*b* is a perspective view of a pad assembly.
Figure 4:
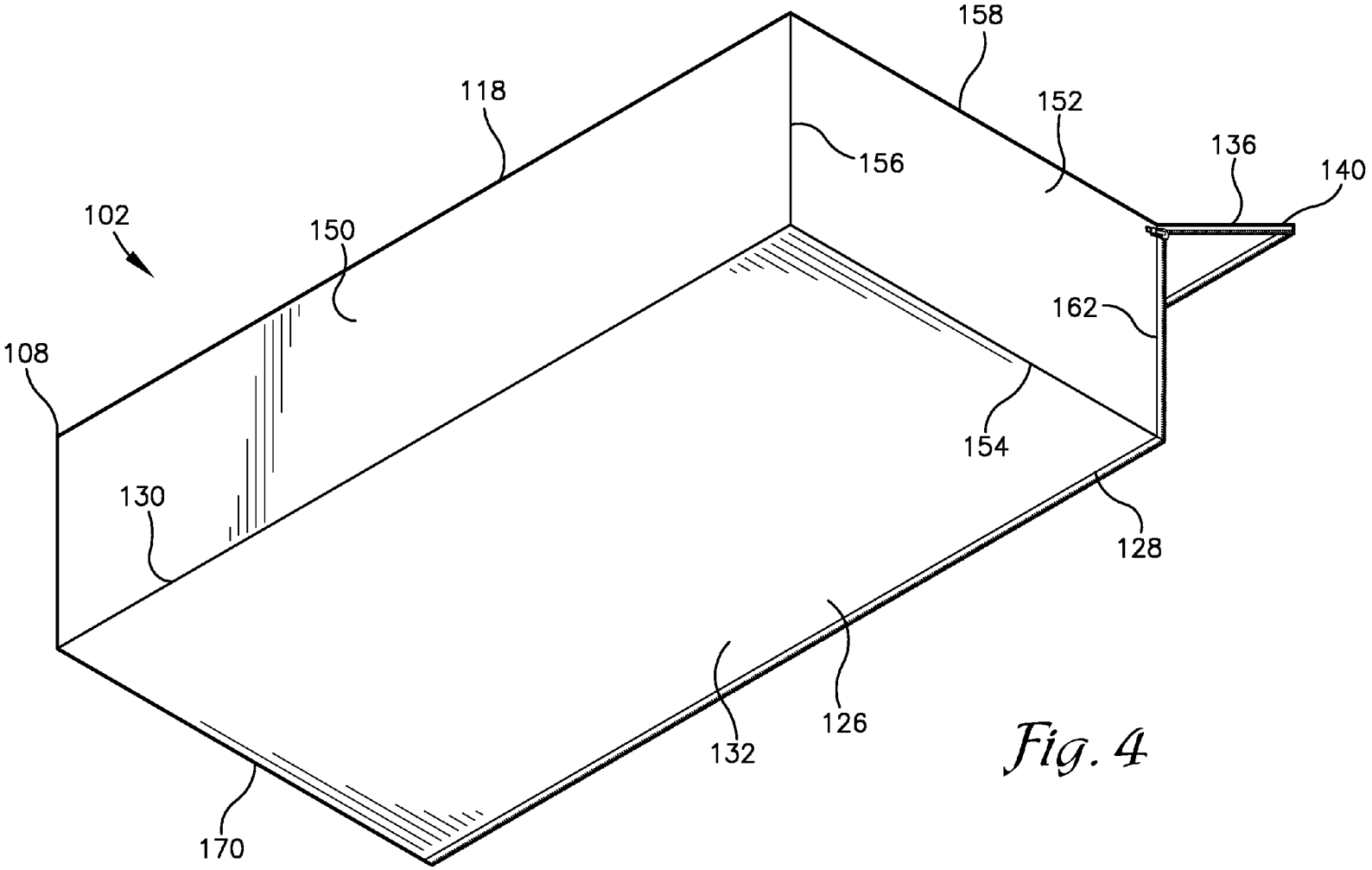
FIG. 4 is a perspective view from the rear of the configurable seating assembly.
Figure 5:
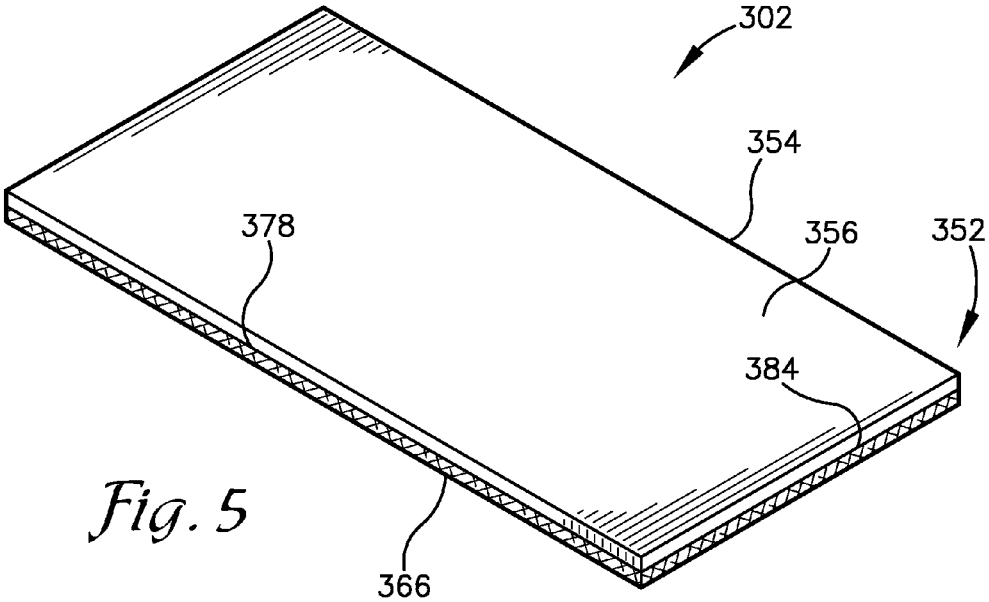
FIG. 5 is a perspective view from above of a pad assembly.
Figure 6:
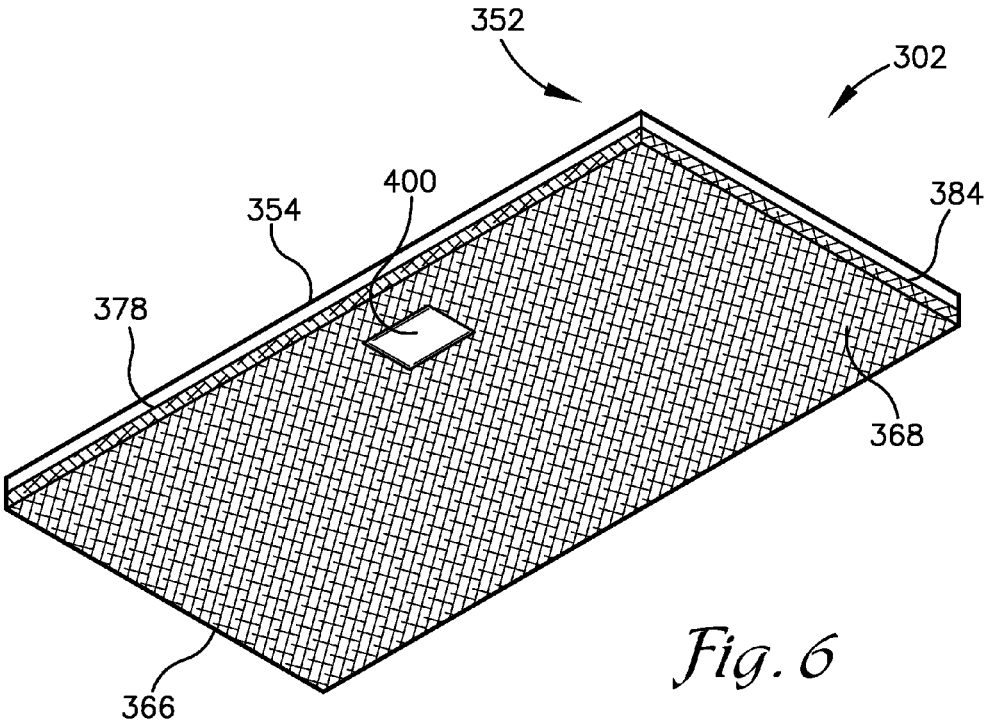
FIG. 6 is a perspective view from below of the pad assembly.

When the configurable seating assembly 102 is used as a seating apparatus 186, the face 132 of the bottom panel 126 is in contact with the ground or floor, and the pad assemblies 302 are secured within the compartments of the cover assembly 104 providing structure and support for the seating assembly 102. The compartments aid in retaining the position of the pad assemblies 302 when a user is sitting on top of the seating assembly 102. When the assembly 102 is used as a mat assembly 304, the first front panel 136 is unsecured from the cover assembly 104 and one or more of the pad assemblies 302*a, b, c, d, e*, and *f* are removed from the cover assembly 104 and arranged spaced from one another for individual use, such as shown in FIG. 3*b*, or arranged adjacent to each other, such as shown in FIG. 3*a*, allowing a person or child to sit or rest thereon. The assembly 102 is returned to a seating apparatus 186 by returning the pad assemblies 302 to the compartments within the chamber 110 and securing the first front panel 136 to the cover assembly 104.

Referring to FIGS. 9-13 an alternative embodiment configurable seating assembly 502 is shown. The alternative embodiment configurable seating assembly 502 generally includes the components of the configurable seating assembly 102 with the addition of an upper chamber for receiving a wedge assembly 326 thereby defining a back support portion 504. The back support portion 504 comprises a second top panel 520 that is generally rectangular and disposed generally parallel to the bottom panel 126, and extends laterally between a second top edge 560 of the left panel 152 and a second top edge 576 of the right panel 168, and forward from a rear edge 524 located at the back panel 150 toward a front edge 522. A second front panel 534 is generally rectangular and extends laterally between a second front edge 164 of the left panel 152 and a second front edge 180 of the right panel 168, and upwardly and rearwardly from the first top panel 114 to the second top panel 520 front edge 522 forming a back rest surface.

The wedge assembly 326 includes a wedge body 328 having a bottom face 336 extending laterally between a left face 338 and a right face 340, and rearward toward a rear face 332. The rear face 332 extends upward generally perpendicular from the bottom face 336 between the left and right faces 338, 340 terminating at a top face 334. The top face 334 is generally parallel to the bottom face 336 and extends laterally between the left and right faces 338, 340, and forward to a front face 330. The front face 330 extends upward from the bottom face 336 at an acute angle to the bottom face between the left and right faces 338, 340, and extends rearward toward the top face 334 thereby defining a generally elongated wedge body 328. When viewed from either the left face 338 or the right face 340, the wedge assembly 326 tapers from a relatively wide lower portion to a relatively narrow upper portion.

When the alternative embodiment configurable seating assembly 502 is used as a seating apparatus, the pad assemblies 302 are secured within the cover assembly 104, and the wedge assembly 326 is secured within the upper chamber. The upper chamber is accessed by a panel 582. The panel 582 is generally rectangular, and may be formed from the first top panel 114 or connected to a rear edge of the first top panel 114. A panel 582 formed from the first top panel 114 extends laterally between a left edge at the left panel 152 and a right edge 588 at a right panel 168, and rearwardly to a rear edge 584 at the back panel 150. In an embodiment, the left edge 586, rear edge 584, and right edge 588 are connected to the left panel 152, back panel 150, and right panel 168, respectively, by a cooperating removable connector, such as a zipper 590, thereby providing an opening accessible from within the cover assembly 104 for inserting the wedge assembly 326 into the upper chamber.

It will be appreciated that the components of the seating assemblies 102 and 502 can be used for various other applications. Moreover, the seating assemblies 102 and 502 can be fabricated in various sizes and from a wide range of suitable materials, using various manufacturing and fabrication techniques. In an embodiment, the seating assemblies 102 and 502 include more or less than six pad assemblies and corresponding compartments.

It is to be understood that while certain aspects of the disclosed subject matter have been shown and described, the disclosed subject matter is not limited thereto and encompasses various other embodiments and aspects.

The invention claimed is:

1. A convertible seating assembly storing a plurality of pad assemblies, comprising:
- a first pad assembly and a second pad assembly;
- a cover assembly, comprising:
  - a first top panel;
  - a bottom panel opposite the first top panel;
  - a back panel joining the first top and bottom panels;
  - a left panel joining the first top, bottom, and back panels;
  - a right panel opposite the left panel joining the first top, bottom, and back panels;

a first front panel extending forward from the first top panel to a bottom edge, and laterally between a left edge and a right edge;

an interior bottom panel extending laterally between the left panel and the right panel;

the bottom, back, right, left, and interior bottom panels defining a first compartment adapted for receiving the first pad assembly; and the first top, back, right, left, and interior bottom panels defining a second compartment adapted for receiving the second pad assembly, wherein the second compartment is parallel to and above the first compartment;

the cover assembly forming a back support portion accessible from the cover assembly through the first top panel;

a wedge assembly received within the back support portion, the wedge assembly comprising:

a bottom face extending laterally between a left face and a right face, and rearward toward a rear face;

wherein the first pad assembly within the first compartment extends beneath the wedge assembly supporting the wedge assembly from below;

the rear face extending upward generally perpendicular from the bottom face between the left and right faces, terminating at a top face;

the top face extending forward from the rear face generally parallel to the bottom face between the left and right faces, terminating at a front face;

the front face extending upward from the bottom face at an acute angle to the bottom face, between the left face and the right face, upward to the top face; and wherein, when viewed from the left face, the wedge assembly tapers from a relatively wide lower portion to a relatively narrow upper portion.

2. The convertible seating assembly of claim 1, wherein each of the first pad assembly and the second pad assembly comprises:

a mat; and a mat-cover assembly enveloping the mat, the mat-cover assembly comprising:

an upper cover, comprising:

a top wall;

a front wall depending from the top wall;

a back wall opposite the front wall depending from the top wall;

a left wall depending from the top wall and connected to the front and back wall; and a right wall opposite the left wall connected to the front and back wall depending from the top wall;

a lower cover, comprising:

a bottom wall;

a front wall extending upward from the bottom wall;

a back wall opposite the front wall extending upward from the bottom wall;

a left wall extending upward from the bottom wall and connected to the front and back wall; and a right wall opposite the left wall connected to the front and back wall extending upward from the bottom wall.

3. The convertible seating assembly of claim 2, further comprising a pocket at the upper cover of each of the first pad assembly and the second pad assembly.

4. The convertible seating assembly of claim 1, further comprising a pocket at the top surface of each of the bottom panel and the interior bottom panel.

5. A convertible seating assembly, comprising:

a removable first pad assembly and a removable second pad assembly for arranging on a surface;

a cover assembly, comprising:

a first top panel;

a bottom panel opposite the first top panel;

a back panel joining the first top and bottom panels;

a left panel joining the first top, bottom, and back panels;

a right panel opposite the left panel joining the first top, bottom, and back panels;

a first front panel extending forward from the first top panel to a bottom edge, and laterally between a left edge and a right edge;

an interior bottom panel extending laterally between the left panel and the right panel;

the bottom, back, right, left, and interior bottom panels defining a first compartment adapted for receiving the removable first pad assembly; and the first top, back, right, left, and interior bottom panels defining a second compartment adapted for receiving the removable second pad assembly, wherein the second compartment is parallel to and above the first compartment;

a back support portion at the first top panel forming an upper chamber;

a wedge assembly received within the upper chamber, the wedge assembly comprising:

a bottom face extending laterally between a left face and a right face, and rearward toward a rear face;

the rear face extending upward generally perpendicular from the bottom face between the left and right faces, terminating at a top face;

the top face extending forward from the rear face generally parallel to the bottom face between the left and right faces, terminating at a front face;

the front face extending upward from the bottom face at an acute angle to the bottom face, between the left face and the right face, upward to the top face;

wherein, when viewed from the left face, the wedge assembly tapers from a relatively wide lower portion to a relatively narrow upper portion; and an opening in the first top panel beneath the upper chamber for accessing the upper chamber.

6. The convertible seating assembly of claim 5, further comprising:

a cooperating removable connector disposed along the first front panel left, bottom, and right edge for securing the first front panel to the left panel, bottom panel, and right panel, respectively; and a cooperating removable connector for closing the opening in the first top panel beneath the upper chamber.

* * * * *